United States Patent [19]

Höfer et al.

[11] Patent Number: 4,796,592

[45] Date of Patent: Jan. 10, 1989

[54] FUEL INJECTION PUMP FOR INTERNAL COMBUSTION ENGINES

[75] Inventors: Gerald Höfer, Weissach; Helmut Laufer; Max Straubel, both of Stuttgart, all of Fed. Rep. of Germany

[73] Assignee: Robert Bosch GmbH, Stuttgart, Fed. Rep. of Germany

[21] Appl. No.: 871,135

[22] Filed: Jun. 2, 1986

Related U.S. Application Data

[63] Continuation of Ser. No. 415,302, Sep. 7, 1982, abandoned.

[30] Foreign Application Priority Data

Sep. 29, 1981 [DE] Fed. Rep. of Germany ..... 3138607

[51] Int. Cl.[4] ..... F02M 39/00

[52] U.S. Cl. ..... 123/502; 123/179 L

[58] Field of Search ..... 123/502, 458, 179 L, 123/500, 501, 449

[56] References Cited

U.S. PATENT DOCUMENTS

| | | | |
|---|---|---|---|
| 4,346,688 | 8/1982 | Kaibara | 123/502 |
| 4,378,002 | 3/1983 | Konrath | 123/502 |
| 4,381,751 | 5/1983 | Maisch | 123/454 |
| 4,475,519 | 10/1984 | Eheim | 123/502 |

FOREIGN PATENT DOCUMENTS

| | | | |
|---|---|---|---|
| 2056716 | 3/1981 | United Kingdom | 123/502 |

*Primary Examiner*—Carl Stuart Miller

*Attorney, Agent, or Firm*—Edwin E. Greigg

[57] ABSTRACT

A fuel injection pump for internal combustion engines is proposed having a hydraulic instant-of-injection adjuster, which is exposed to an rpm-dependent pressure formed with the aid of a pressure control valve; the control of the pressure control valve is effected by means of variations of the control pressure acting upon it. This control is accomplished with the aid of at least one electrically controlled valve which is controlled by a control device in accordance with operating parameters. In this cost-efficient manner, the correct adjustment of the instant of injection can be established very precisely over the entire operating range of the engine, including the warm-up phase, at varying operating conditions.

10 Claims, 5 Drawing Sheets

FUEL INJECTION PUMP FOR INTERNAL COMBUSTION ENGINES

This is a continuation of application Ser. No. 415,302 filed Sept. 7, 1982 now abandoned.

BACKGROUND OF THE INVENTION

The invention is based on a fuel injection pump as generally described hereinafter. In a known fuel injection pump of this type, the control of the pressure exerted on the control piston is effected with the aid of a pressure valve, which has a relatively strong spring acting upon a ball-type closing member and in which the closing member can be lifted from its seat, counter to the force of the closing spring, by a temperature-controlled pin. In this manner, when the engine is cold, the injection onset can be adjusted as desired in such a case by increasing the pressure acting on the injection adjusting device, which is effected by increasing the pressure in the pressure chamber of the pressure control valve. However, this embodiment offers only limited opportunities to exert influence on the mode of operation of the pressure control valve or the control of the pressure acting upon the adjusting piston.

OBJECT AND SUMMARY OF THE INVENTION

The fuel injection pump according to the invention has the advantage over the prior art that in a simple manner, the fluid pressure acting upon the adjusting piston can be influenced in accordance with a multiplicity of operating parameters, such as air pressure, air or fuel temperature, rpm or engine temperature by way of controlling the control pressure which is effected in the pressure chamber at the pressure control valve, and which is accomplished with a high degree of precision.

A further advantageous embodiment in accordance with the invention provides that the valve is a switching valve controlled by an electrical control device and that the pressure chamber can be relieved toward the relief chamber independently of the switching status of the swtiching valve by way of at least one spring-loaded closing device. With this embodiment, the instant of injection can be adapted to operating parameters of the engine in a very simple manner without great expense for electronic regulatory means. The adaptation can be effected in more or less small steps by combining the switching valve and spring-loaded closing device acting as a pressure increment valve.

The invention will be better understood and further objects and advantages thereof will become more apparent from the ensuing detailed description of six preferred embodiments taken in conjunction with the drawings.

DESCRIPTION OF THE PREFERRED EMBODIMENTS

Figure 1:
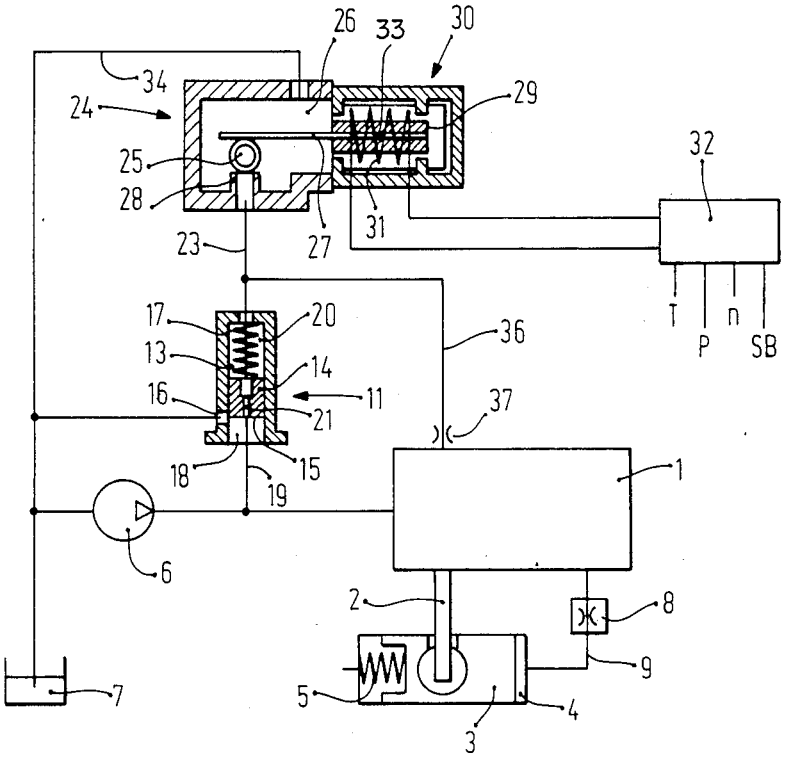
FIG. 1 shows a first exemplary embodiment according to the invention having a valve which is exposed to a closing force variable in analog fashion and which serves to control the control pressure of the pressure control valve.

An adjusting piston engages the cam drive of a fuel injection pump 1, which is not shown in further detail here, via a pin 2 for adjusting the instant of the onset of injection. The adjusting piston 3 is displaceable counter to a restoring spring 5 by means of a pressure fluid located in a work chamber 4; the farther the piston is displaced toward the spring, the earlier the instant of injection is shifted with respect to top dead center of a piston of the associated engine. A supply pump 6 aspirates fuel from a fuel container 7 and pumps it into a suction chamber of conventional embodiment, not shown, in the fuel injection pump, from whence the pump work chambers of the fuel injection pump are supplied with fuel. The work chamber 4 communicates with the suction chamber via a line 9 which contains a throttle 8. With the aid of a pressure control valve 11, the supply pressure of the supply pump 6 and thus the pressure in the suction chamber are controlled at first in accordance with rpm; with increasing rpm, the pressure increases proportionally. This rpm-dependent pressure has the effect that with increasing rpm the injection adjusting piston 3 is displaced in the direction of an adjustment of the instant of injection toward "early".

Figure 3:
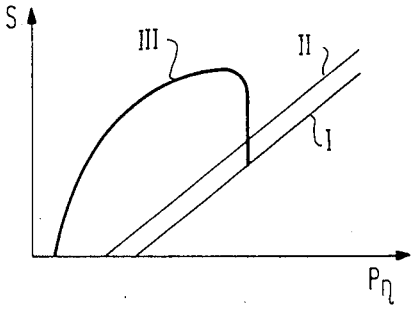
FIG. 3 is a diagram showing the course of travel of the adjusting piston.

In FIG. 3, a diagram is shown in which the stroke s of the adjusting piston is plotted over the rmp n. I indicates the characteristic curve for the case of normal operation. With increasing rpm, a linear shift toward "early" occurs. A characteristic curve extending parallel to this is marked II, and this latter curve would have to be adhered to if the engine were being driven at higher altitudes than usual, for instance at an altitude of 2,200 m. Similar shifts are also brought about for other environmental conditions, such as air or fuel temperature or the temperature of the engine.

In order to influence the pressure exerted upon the adjusting piston 3, the pressure control valve 11 is given the following embodiment: the pressure control valve 11 has a control piston 14, which is disposed in a tightly displaceable manner in a cylinder 13 and with one end face 15 controls an outflow opening 16 in the wall of the cylinder 13. The outflow opening leads to a relief chamber, which may be for instance the intake side of the supply pump 6 or the fuel container 7. On the other side, the control piston 14 is stressed by a control spring 17 fastened between the control piston 14 and the closure wall on the end of the cylinder 13, in such a manner that the control piston 14 has the tendency to close the outflow opening 16. The first end face 16 of the control piston 14 adjoins a chamber 18, which communicates via a pressure line 19 with the pressure side of the supply pump 6.

On the rear of the control piston 14, a control pressure chamber 20 is enclosed within the cylinder 13 and communicates via a throttle 21 in the control piston 14 with the chamber 18. A pressure line 23 leads out of the control pressure chamber 20 and to a pressure valve 24. This pressure valve 24 has a ball 25 as its closing member, which controls the mouth of the pressure line 23 into a valve chamber 26. A relief line 34 leads out of the valve chamber 26 to the relief chamber, which again may be either the intake side of the supply pump 6 or the fuel container 7. This valve closing member 25 is stressed by a resilient arm 27 and is held in place with respect to the strut-like mouth 28 of the pressure line 23. The resilient arm is part of a rotating armature 29 of an electromagnet apparatus 30 in which the armature rotates about its axis at the mid-point shown by the black dot 33. This apparatus 30 has a field winding 31, which is supplied with current from an electric control device 32. The electric control device 32 produces a control current formed in accordance with the operating parameters to be taken into consideration. By means of this control current, a more or less strong torque is exerted upon the rotating armature. At the same time, a basic restoring force also acts upon the rotating armature, being generated in a known manner either by springs or by permanent magnetism. Depending upon the excitation of the field winding 31, the resilient arm 27 thus exerts more or less pressure upon the closing number 25 and thus determines the pressure in the control pressure chamber 20. When the engine is cold, the strut-like mouth or valve seat 28 can be closed entirely by exerting an appropriate amount of current.

This effect is shown in FIG. 3 by the curve III. Given an absence of a pressure drop between the control pressure chamber 20 and the chamber 18 ahead of the control piston 14, the control piston 14 is displaced by the control spring 17 such that the outflow opening 16 is closed entirely. In a corresponding manner, the entire quantity of fuel pumped by the supply pump 7 is delivered to the suction chamber of the fuel injection pump for the purpose of building up pressure; this flow causes a substantially steeper course of pressure increase and results in a corresponding shift of the instant of injection toward "early". Upon the attainment of a predetermined temperature of the engine, the pressure control valve 24 can then assume its intended mode of operation, according to one of the curves I and II, after the relief line 34 has been opened.

Figure 2:
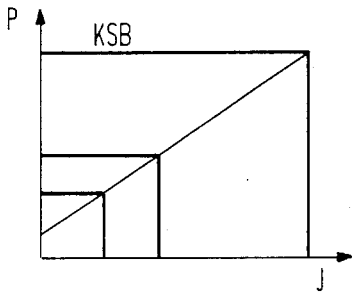
FIG. 2 is a diagram showing the control current course in the embodiment of FIG. 1.

In FIG. 2, the linear relationship between the exertion of current upon the field winding 31 and the control pressure attainable in the control pressure chamber 20 is shown.

In a further embodiment, the suction chamber of the fuel injection pump 1 can communicate via a ventilation line 36 with the pressure line 23. A throttle 37 is disposed in the ventilation line 36 but is substantially smaller than the throttle in the throttle bore 21. In an advantageous manner, the scavenging fuel quantity is used in order to influence the pressure in the control pressure chamber 20. Naturally, the communication between the control pressure chamber 20 and the pressure side of the supply pump 6 can be realized exclusively via such a line 23, instead of via the throttle bore 21.

By means of the above-described realization of the apparatus according to the invention, the pressure in the control pressure chamber 20 is thus controlled in analog fashion by means of a control device which is capable of taking into consideration all the parameters which are relevant to adjusting the instant of injection. A temporary early adjustment of the instant of injection when the engine is cold can take place in a superimposed manner.

Figure 4:
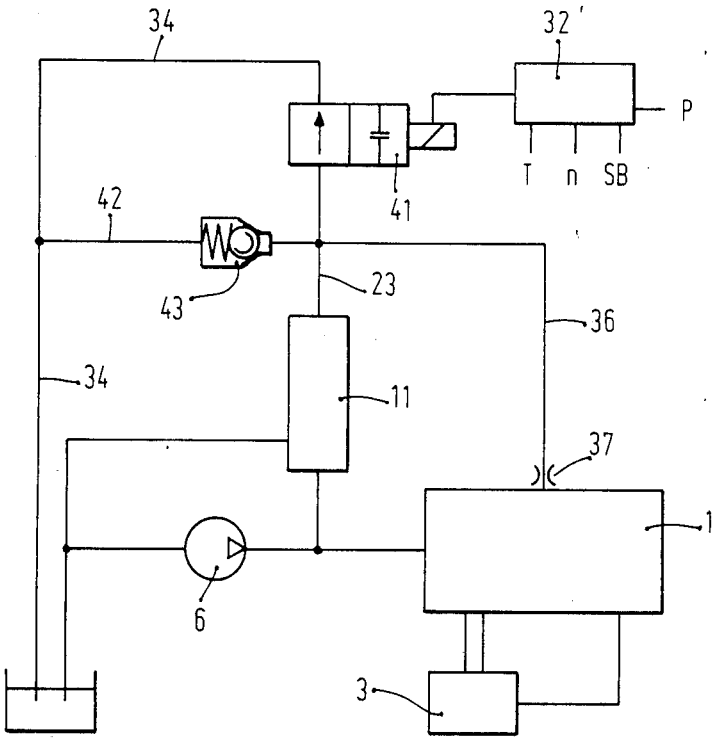
FIG. 4 shows a second exemplary embodiment having a switching valve and a check valve for controlling the control pressure of the pressure control valve.

The embodiment of FIG. 4 is made up of the same elements as the embodiment of FIG. 1. Here again, a fuel pump 6 pumps fuel into the suction chamber of a fuel injection pump 1, which for the purpose of adjusting the instant of injection has an adjusting device with an adjusting piston 3 as in the exemplary embodiment of FIG. 1. The pressure side of the supply pump 1 is furthermore connected with a pressure control 11 of identical design, the control pressure chamber of which can be relieved via the pressure line 23. In this exemplary embodiment, the pressure line 23 leads to a switching valve 41, which takes the place of the pressure valve 24 of the exemplary embodiment of FIG. 1. This valve 41, embodied as a two/two-way valve is electromagnetically controlled by a control device 32', which emits switching pulses formed on the basis of operating parameters to the switching valve 41. The relief line 34 leads from the switching valve 41 to a relief chamber which may be for instance the fuel container 7. In an analogous manner to the embodiment of FIG. 1, a connection can be established via the pump suction chamber and the pressure line 34 via a ventilation line 36 which contains a throttle 37. In an additional feature, a pressure valve 43 is disposed parallel to the switching valve 41 in a bypass line 42; the pressure valve 43 is embodied as a check valve opening toward the relief side.

Figure 5:
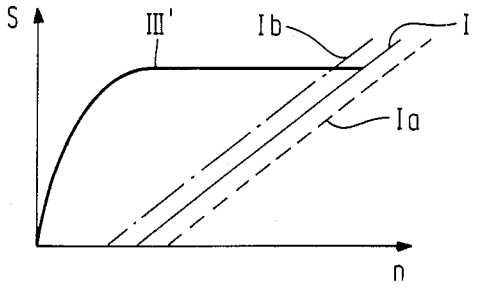
FIG. 5 shows the course of travel of the adjusting piston with varying rpm.

The switching valve 41 in this embodiment can be controlled in a clocked manner by the control device 32', and the duty cycle is varied in accordance with the operating parameters ascertained by the control device 32'. In this case, a quasi-analog control pressure is established in the control pressure chamber of the pressure control valve 11, similarly to the embodiment of FIG. 1. The pressure valve 43 is embodied as a pressure limitation valve, with the aid of which an excessively high pressure on the supply side of the supply pump or in the suction chamber is avoided, which is of particular importance when the switching valve 41 is continuously closed during the warm-up phase of the engine. In the diagram in FIG. 5, the travel of the adjusting piston is plotted in accordance with the rpm in the case of cold starting. The pressure elevation resulting upon cold starting, differing from the linear course of pressure when the engine is warm, at first rises steeply until the opening pressure of the pressure valve 43 has been attained. Beyond this point, the curve III' has a horizontal course until the warm-up phase has ended. In the diagram of FIG. 5, an injection adjustment curve 1 is also shown, plotted over the rpm and corresponding to an average operating condition for normal operation. The curves Ia and Ib parallel to it represent the adjustment range attainable with the aid of the switching valve 41.

Figure 6:
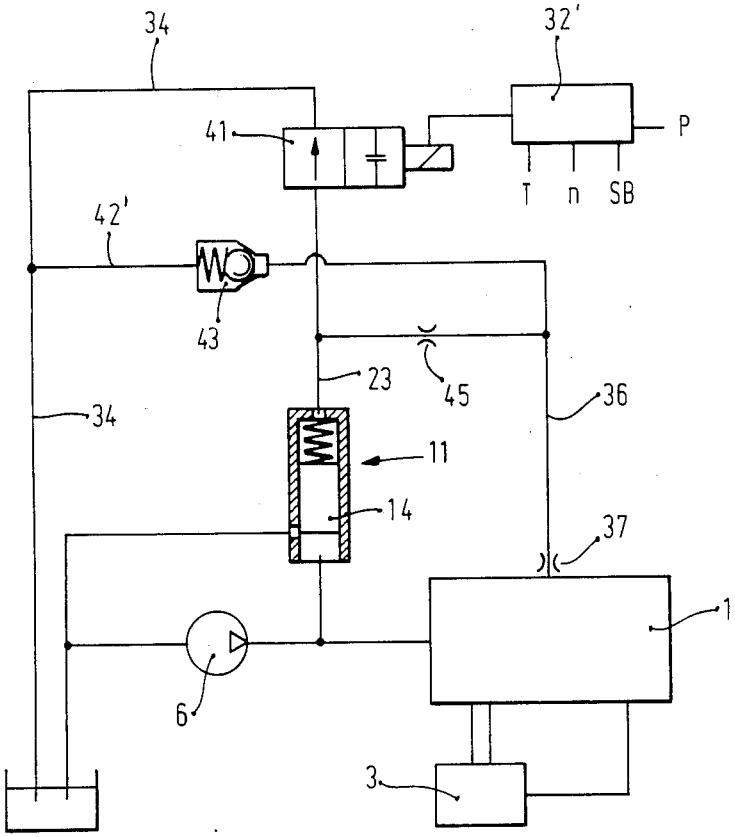
FIG. 6 shows a third exemplary embodiment, modified from that of FIG. 4, having throttles for compensating for the influence of rpm.

In the case where the control pressure in the pressure control valve 11 is influenced by means of clocked control of the switching valve 41, a variation in control pressure appears when there is a variation in rpm while the duty cycle remains the same. This condition may be undesirable for control purposes and would then necessitate an rpm-dependent correction. In order to avoid this, the embodiment of FIG. 6 makes a modification of the embodiment of FIG. 4 such that a second throttle 45 is inserted into the line 36 downstream of the first throttle 37. As in FIG. 4, the line 36 in FIG. 6 discharges into the pressure line 23, which in turn connects the pressure control valve 11 with the switching valve 41. A throttle bore 21 in the control piston 14 such as that in the embodiment of FIG. 1 is omitted here. The bypass line 42 provided in FIG. 4 now, in the form of a bypass line 42', branches off from the line 36 between the first throttle 37 and the second throttle 45 and contains the pressure valve 43, which is now no longer embodied as a pressure limitation valve for the maximum permissible pressure but instead is set for a lower pressure in such a manner that the fuel flowing to the pressure line 23 via the second throttle 45 or to the control pressure chamber of the pressure control valve 11 is no longer subjected to an rpm-dependent pressure. It is now possible, because of the uncoupling effected by the outflow via the pressure valve 43 resulting from the two throttles 37 and 45, to make an initial pressure available which is not dependent on rpm; thus the control pressure remains independent of rpm, while the duty cycle of the triggering of the switching valve 41 remains the same.

Figure 7:
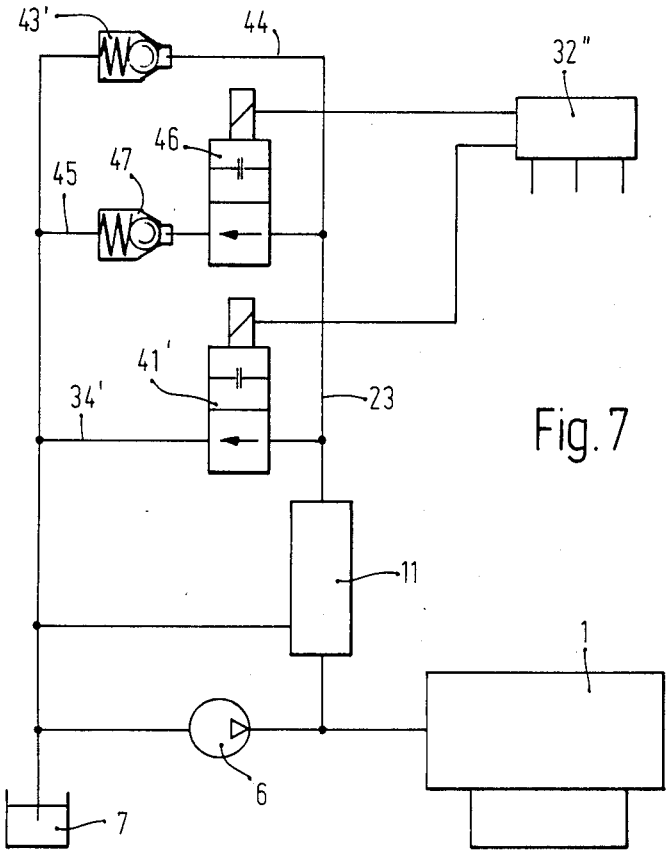
FIG. 7 shows a fourth exemplary embodiment in the form of a modification of the embodiment of FIG. 4.
Figure 8:
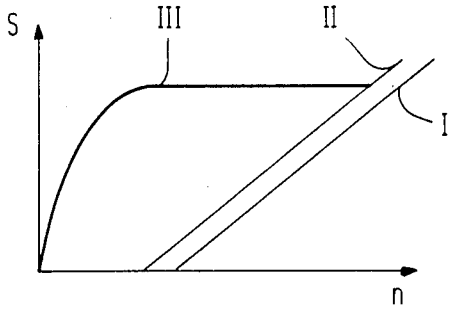
FIG. 8 is a diagram showing the adjusting travel of the adjusting piston attainable with the fourth exemplary embodiment, plotted over the rpm.

The control pressure for the control pressure valve 11 may also, however, be varied in increments using a control circuit of the simplest embodiment. To this end, the embodiment of FIG. 4 is modified as shown in FIG. 7 as follows: the control pressure chamber of the pressure control valve 11, as before, is relieved by means of the pressure line 23 which leads to a switching valve 41'. From this switching valve, the relief line 34' leads to the relief chamber, in this case to the fuel container 7. A second relief line 44 also branches off from the pressure line 23 and has a pressure valve 43' disposed in it. This pressure valve 43' corresponds to the pressure valve 43 in the bypass line 42 in the embodiment of FIG. 4 and limits the maximum pressure prevailing on the supply side of the supply pump 6. A first additional relief line is also provided parallel thereto and containing a second switching valve 46 and, downstream from it, a second pressure valve 47. Both switching valves are controlled by an electric control device 32", which as in the foregoing exemplary embodiments ascertains the operating parameters required for adjusting the instant of injection. This control device 32", depending upon operating conditions, keeps both magnetic valves closed and opens either one or the other of the switching valves. For cold starting conditions, both switching valves are closed, so that the pressure on the supply side of the supply pump 6 can increase in an unhindered manner until it is limited in its maximum value by the pressure valve 43'. This is represented by the curve III in FIG. 8, where the pressure prevailing in the suction chamber, which also acts upon the adjusting piston for adjusting the instant of injection, is plotted over the rpm. The diagram also shows two curves I and II, extending parallel to one another and having a constant slope; these curves represent the linear pressure increase with increasing rpm in the suction chamber under various control conditions of the pressure control valve 11. Curve I shows the adjusting characteristic during normal conditions for the engine. In this engine, the first switching valve 41' is opened and the second switching valve 46 is closed. In order to attain an adjustment toward "early" as compared with the normal setting for the instant of injection, the second switching valve 46 is opened and the first switching valve 41' is closed. The fuel is now capable of flowing out from the pressure line 23 via the second pressure valve 47 toward the relief side, and the opening pressure of the second pressure valve 47 is at a lower level than the opening pressure of the pressure valve 43'.

Figure 9:
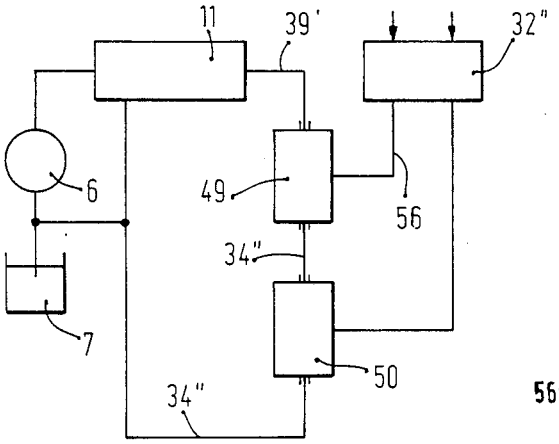
FIG. 9 shows a fifth exemplary embodiment.

A similar incremental adjustment is possible with the embodiment shown in FIG. 9. Here again, the supply pump 6 supplies the fuel injection pump (not shown) with fuel from the fuel supply container 7. The pressure side of the fuel supply pump 6 communicates with the pressure control valve 11, from the control pressure chamber of which the pressure line 39' branches off. This pressure line 39' leads to a first valve assembly 49, which is controlled by an electric control device 32". This is similar in structure to the control device 32" of the exemplary embodiment of FIG. 7 and takes into consideration the parameters of significance for adjustment of the instant of injection. The outlet of the first valve assembly 49 communicates with a relief line 34", in which a second valve assembly 50, which is likewise controlled by the electric control device 32", is disposed. The outlet of the second valve assembly 50 leads, as a relief line 34", back to the intake side of the supply pump 6.

Figure 10:
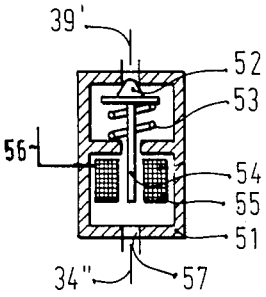
FIG. 10 is a detailed view of part of the system of the exemplary embodiment of FIG. 9.

The structure of the valve assemblies 49 and 50 is shown in more detail in FIG. 10. They comprise a valve housing 51, in which a valve closing member 52 is disposed, which controls the entrance, for instance of the pressure line 39', into for instance the first valve assembly 49. The valve closing member is stressed by a compression spring 53, which is supported on the housing and imparts to the valve closing member 52 the working characteristic of a pressure limitation valve. Also connected with the valve closing member 52 is an armature 54, which dips into an annular coil 55. The annular coil 55 is triggered by the control device 32" via a current supply line 56. The interior of the valve assembly 49 further has an outlet 57, by way of which it communicates continuously with the relief line 34" connected to it.

The second valve assembly 50 has the same structure as the first valve assembly 49, with the exception that the closing force of the compression spring 53 is smaller in the first valve assembly 49 than that of the compression spring of the second valve assembly 50.

Accordingly, when the annular coil is not excited, the two valve assemblies 49 and 50 function as pressure limitation valves disposed in series one after the other. This status corresponds to operation in the warm-up phase of a cold engine. As a result of the valves switched in sequence as described, fuel is capable of flowing out only at a very high pressure, so that with increasing rpm at the onset of operation of the engine, the pressure in the suction chamber is capable of increasing very rapidly at first. Since no fuel flows out via the pressure line 39', the same pressure prevails in the control pressure chamber of the pressure control valve as on the pressure side of the supply pump or in the suction chamber of the injection pump. The pressure control valve accordingly closes. With increasing rpm, however, the pressure can increase only to such an extent that both valve assemblies 49 and 50 open.

Figure 11:
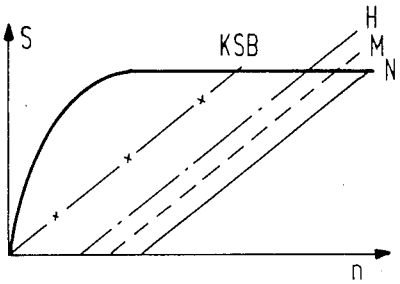
FIG. 11 is a diagram showing the adjustment characteristic attainable with the embodiment of FIG. 9.

Now if the magnetic windings 55 of both valve assemblies are excited, then the valve closing members 52 are lifted from their seats counter to the force of the valve closing springs 53, and communication between the pressure line 39' and the relief line 34" toward the relief side is again established. This condition represents normal operation. As may be seen from FIG. 11, the pressure in the suction chamber of the engine or in the work chamber of the adjusting piston then increases linearly with increasing operation when the engine is warm or in other words after the end of the warm-up phase. If in contrast only one of the valve assemblies is opened, then either the curve M located parallel to and at the left of the normal curve N—curve M representing the operation of the engine at medium altitude—or the parallel curve H located still further to the left is established, curve H representing operation of the engine at high altitudes. In an advantageous manner, using only two valve assemblies and with a very simply embodied electrical control device, it is possible to adapt the onset of injection to the important operating situations of the engine being driven with the fuel injection pump in question. The electrical control device substantially comprises theshold switches which are provided with switching thresholds controlled by corresponding transducers for the operating parameters and are adapted appropriately.

Figure 12:
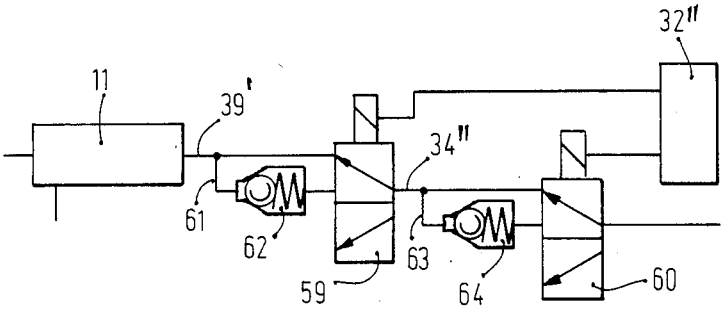
FIG. 12 shows a sixth exemplary embodiment in the form of a modification of the embodiment of FIG. 9.

FIG. 12 shows a modified embodiment to the embodiment of FIG. 9. Here, in place of the switching assemblies 49 and 50, a first switching valve 59 and a second switching valve 60 are provided. These valves are embodied as two-position, three-way valves and can be switched electromagnetically. The pressure line 39' leading away from the pressure control valve 11 leads to one input of the first switching valve 59, the output of which is continuously connected with the relief line 34''. A first bypass line 61 branches off from the pressure line 39', leading to the second input of the first switching valve 59, and contains a first pressure increment valve 62. The second switching valve 60 is also included in the relief line 34'', and a second bypass line 63 branches off from the relief line 34'' upstream of the second switching valve 60, leading to the other input of the second switching valve 60. A second pressure increment valve 64 is disposed in the second bypass line 63.

The switching valves 59 and 60 are switched by the control device 32'' such that they either open up the passageway between the pressure line 39' and the relief line 34'' or else furnish communication via the bypass line 61 or 63. This switching state corresponds to the switching state of the first switching assembly 49 or the second switching assembly 50 in the exemplary embodiment of FIG. 5 when the magnetic winding 55 is not excited. The pressure increment valves are furthermore designed such that the first pressure increment valve 62 has a lower opening pressure than the second pressure increment valve 64. If the two pressure increment valves are switched in series one behind the other, then this corresponds to the cold-starting situation. In that case, a high pressure builds up very rapidly on the supply side of the supply pump 6, this pressure being limited only by the common opening pressure of the two pressure increment valves. The pressure diagram (see FIG. 11) illustrates the resultant curve KSB, plotted over the rpm. If only one of the pressure increment valves 62 or 64, or both, are switched for passage therethrough, then one of the parallel curves H, M or N is the result.

Naturally, further pressure gradations can also be built into this system, in which still further switching valves or pressure increment valves are disposed in sequence one behind the other. Increments of correspondingly finer graduations can be attained by the parallel disposition of switching valves and pressure valves in the embodiment of FIG. 7 as well.

The above-discussed forms of embodiment have the advantage that a separate thermostatic pressure increase device for adjusting the onset of injection during cold starting is no longer needed, and various operating ranges of the engine can be taken into consideration in a simple manner with simple control.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a fuel supply pump driven in synchronism with said fuel injection pump, the pressure side of said fuel supply pump communicating with a work chamber ahead of an adjusting piston for the purpose of adjusting an injection onset and with said adjusting piston exposed to a restoring force, said fuel supply pump further communicating with a relief chamber for generating an rpm-dependent control pressure, a pressure control valve, an outflow opening in said pressure control valve communicating with said relief chamber and controlled by a control piston of said pressure control valve, said control piston being exposed on its rear side to a restoring force, a control pressure chamber in said pressure control valve located on the rear side of said control piston communicating via a throttle connection with the pressure side of said fuel supply pump and via a relief line communicating with said relief chamber, and a switching valve means disposed in said relief line controllable in accordance with operating parameters by an electric control means, and at least one spring-loaded closing means communicating with said relief chamber and with said control pressure chamber, whereby said control pressure chamber is relieved by said at least one spring-loaded closing means toward said relief chamber independently of the switching status of said switching valve means.

2. A fuel injection pump as defined by claim 1, further comprising means for controlling said switching valve means in a clocked manner having a duty cycle which is variable in accordance with one or more operating parameters.

3. A fuel injection pump as defined by claim 2, wherein said control pressure chamber communicates via a first throttle and via a pressure medium line containing a second throttle with the pressure side of said fuel supply pump, and a second relief line, containing said at least one spring-loaded closing means, connected between said first throttle and said second throttle and leading to said relief chamber.

4. A fuel injection pump as defined by claim 1, further comprising a second relief line parallel to said first relief line, the cross section thereof being controlled by said at least one spring-loaded closing means, and at least one additional relief line containing a pressure valve means, whereby said pressure valve means is opened alternatively to said first relief line.

5. A fuel injection pump as defined by claim 4, further comprising a second switching valve means disposed in said at least one additional relief line.

6. A fuel injection pump as defined by claim 4, wherein said switching valve disposed in said first relief line comprises a three-way valve for simultaneously controlling said at least one additional relief line.

7. A fuel injection pump as defined by claim 1, wherein said switching valve means comprises said at least one spring-loaded closing means and a magnetic winding for lifting said closing means counter to its spring-biased position, said closing means controlling the cross section of said relief line.

8. A fuel injection pump as defined by claim 7, further comprising at least one additional switching valve means disposed in series downstream of said first switching valve means in said relief line and having a valve closing member stressed by the force of a closing means, the closing force of said closing means of said first switching valve being smaller than the closing force of said closing means of said at least one additional switching valve means, whereby said electric control means can switch individually or in common in order to generate pressure increments said first switching valve means and said at least one additional switching valve means.

9. A fuel injection pump as defined by claim 1, wherein said at least one spring-loaded closing means comprises a pressure increment valve disposed in a parallel line to said relief line and said switching valve means comprises a two-position, three-way valve, whereby said valve means opens either the passage to said relief line or the passage to said parallel line.

10. A fuel injection pump as defined by claim 9, characterized in that said parallel line comprises a first bypass line, and at least one additional two/three-way switching valve disposed in said relief line downstream of the re-entry of said first bypass line into said relief line and into an additional bypass line bypassing said relief line, and said additional bypass line containing an additional pressure increment valve controllable alternatively to said relief line by an additional switching valve means, the closing force of said first pressure increment valve being smaller than that of said at least one additional pressure increment valve, and said switching valve and said at least one additional switching valve are switchable either individually or in common by said electric control means.

* * * * *